United States Patent [19]

Katayose et al.

[11] 4,421,082

[45] Dec. 20, 1983

[54] ENGINE CONTROL APPARATUS

[75] Inventors: Shinji Katayose, Tokyo; Masatsugu Ohwada, Yokosuka, both of Japan

[73] Assignee: Nissan Motor Company, Limited, Yokohama, Japan

[21] Appl. No.: 408,628

[22] Filed: Aug. 16, 1982

[51] Int. Cl.[3] ..... F02D 33/00

[52] U.S. Cl. ..... 123/333; 123/179 G; 123/198 DB

[58] Field of Search ..... 123/325, 332, 333, 334, 123/179 G, 179 B, 179 BG, 198 F, 198 DB, 198 DC

[56] References Cited

U.S. PATENT DOCUMENTS

| | | | |
|---|---|---|---|
| 3,703,162 | 11/1972 | Adno | 123/325 |
| 4,153,033 | 5/1979 | Iizuka | 123/198 F |
| 4,192,279 | 3/1980 | Maisch et al. | 123/325 |
| 4,322,947 | 4/1982 | Wössner et al. | 123/325 |
| 4,362,133 | 12/1982 | Malik | 123/179 G |
| 4,371,050 | 2/1983 | Ikeura | 123/198 DB |

FOREIGN PATENT DOCUMENTS

| | | |
|---|---|---|
| 50-9636 | 1/1975 | Japan . |
| 51-38968 | 10/1976 | Japan . |
| 2062291 | 5/1981 | United Kingdom . |
| 2069180 | 8/1981 | United Kingdom . |

*Primary Examiner*—William A. Cuchlinski, Jr.
*Attorney, Agent, or Firm*—Schwartz, Jeffery, Schwaab, Mack, Blumenthal & Koch

[57] ABSTRACT

An engine control apparatus comprises a first control circuit for terminating delivery of fuel to the engine upon the occurrence of two conditions; namely, when the throttle valve opens at an angle less than a predetermined value and the transmission is in high gear or in neutral. The apparatus also comprises a second control circuit for restarting the engine when the three conditions are fulfilled; namely, when the transmission is in low gear, the engine is operating at a speed less than a predetermined value, and the clutch is disengaged.

17 Claims, 21 Drawing Figures

ENGINE CONTROL APPARATUS

BACKGROUND OF THE INVENTION

This invention relates to an apparatus for controlling an internal combustion engine of an automotive vehicle and, more particularly, to such an engine control apparatus for terminating delivery of fuel to the engine in selected modes of engine operation.

Various engine control apparatus have been proposed in the past for terminating delivery of fuel to an internal combustion engine in selected modes of engine operation, but such prior apparatus have demonstrated very poor fuel economy.

A conventional engine control apparatus includes a solenoid valve provided in a fuel conduit through which fuel is delivered to an internal combustion engine. The solenoid valve is connected to a potential source through a parallel circuit of a clutch switch which is closed when the clutch is disengaged, a neutral switch which is closed when the transmission is in neutral, a throttle switch which is closed when the throttle valve opens over a predetermined angle, and a relay switch which is closed when the vehicle speed exceeds a predetermined value. The solenoid valve closes to terminate fuel delivery to the engine only when all of these switches are open. Therefore, such a conventional apparatus cannot save unnecessary fuel when the clutch is disengaged, the transmission is in neutral, or the vehicle is at rest.

A second type of conventional engine control apparatus includes a clutch pedal switch for generating a signal indicative of the clutch pedal being depressed, a vehicle speed sensor for generating a signal indicative of the vehicle being running, and a control circuit for connecting the ignition system to a power source in response to the signal from the clutch pedal switch or the signal from the vehicle speed sensor. The control circuit disconnects the ignition system from the power source to bring the engine to a stop in the absence of the signal from the clutch pedal switch and the signal from the vehicle speed source. Therefore, such a conventional apparatus cannot save unnecessary fuel during deceleration.

The present invention provides an improved engine control apparatus which can save unnecessary fuel in selected modes of engine operation to achieve more fuel economy and less exhaust emission.

SUMMARY OF THE INVENTION

There is provided, in accordance with the present invention, an apparatus for controlling an internal combustion engine of an automotive vehicle having a transmission, a clutch, a throttle valve, and sources for deriving signals indicative of: (a) the throttle valve opening at an angle less than a predetermined value, (b) the transmission being in high gear or in neutral, (c) the transmission being in low gear, (d) the engine operating at a speed less than a predetermined value, and (e) the clutch being disengaged. The apparatus comprises means for terminating delivery of fuel to the engine upon the occurrence of two conditions indicating by signals (a) and (b), and means for restarting the engine upon the occurrence of three conditions indicated by signals (c), (d) and (e).

Preferably, the means for terminating delivery of fuel to the engine includes a hold circuit for maintaining fuel delivery to the engine until the two conditions indicated by signals (a) and (b) continue over a predetermined time. Alternatively, the means for terminating delivery of fuel to the engine may include a hold circuit for maintaining fuel delivery to the engine until the condition indicated by signal (b) continues over a predetermined time.

In a preferred embodiment, the means for terminating delivery of fuel to the engine includes means for maintaining fuel delivery to the engine unless the clutch is engaged.

BRIEF DESCRIPTION OF THE DRAWINGS

The details as well as other features and advantages of this invention are set forth below and are shown in the accompanying drawings, in which.

Figure 1:
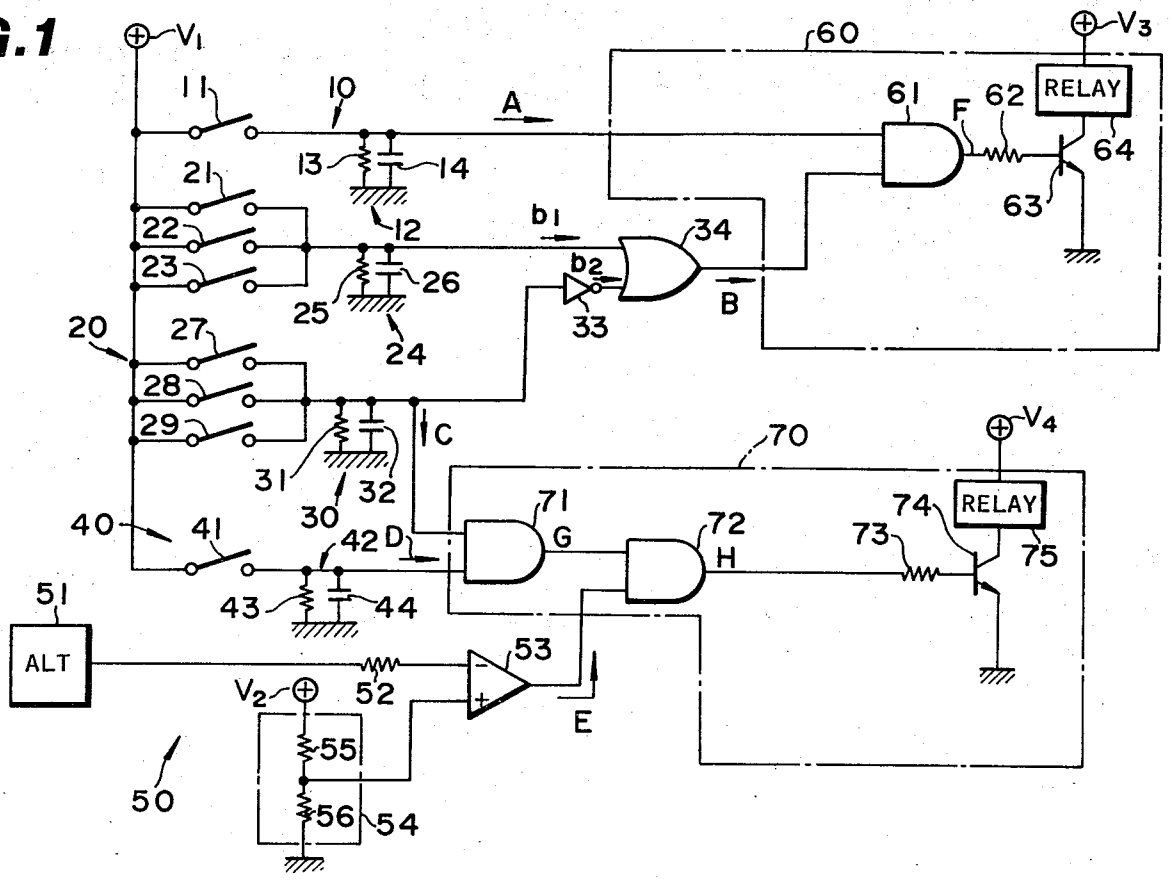
FIG. 1 is a circuit diagram showing one embodiment of an engine control apparatus made in accordance with the present invention.

With reference now to the conventional engine control apparatus shown in the prior art figure, fuel to an internal combustion engine is supplied through a fuel conduit 1 having therein a solenoid valve 2 which opens to permit fuel delivery to the engine when energized and closes to block fuel flow through the fuel conduit 1 when deenergized. The solenoid valve 2 is connected to a source of potential 3 through a parallel circuit of a clutch switch 4, a neutral switch 5, a throttle switch 6, and a relay switch 7. The clutch switch 4 closes when the clutch pedal is depressed to disengage the clutch. The neutral switch 5 closes when the transmission is in neutral. The throttle switch 6 opens when the throttle valve 8 opens at an angle less than a predetermined value. The realy switch 7 closes when the vehicle is running at a speed more than a predetermined value. Therefore, the solenoid valve can close to terminate fuel delivery to the engine only when all of the switches 4, 5, 6 and 7 open, that is, only when the clutch is engaged, the transmission is not in neutral, the throttle valve opens at an angle less than a predetermined value, and the vehicle is running at a speed less than a predetermined value.

DESCRIPTION OF THE PREFERRED EMBODIMENTS

Referring now to FIG. 1 of the drawings, there is illustrated one embodiment of an engine control apparatus made in accordance with the present invention, wherein it is contemplated for use in conjunction with an automotive vehicle equipped with a manual transmission. The engine control apparatus comprises various sensors including a throttle position sensor 10, a gear position sensor 20, a clutch position sensor 40, and an engine speed sensor 50.

The throttle position sensor 10 includes a throttle switch 11 which is associated with a throttle valve (not shown but well known in the art) situated within the induction passage for controlling the flow of air or air-fuel mixture to the engine depending upon the amount of an accelerator pedal is depressed. The throttle switch 11 closes when the throttle valve position is at an angle less than a predetermined value, for example, 6.5° open. The throttle switch 11 is connected at its first terminal to a source of constant voltage V1. The second terminal of the throttle switch 11 is connected to ground through a parallel circuit 12 of a resistor 13 and a capacitor 14 and also to a fuelcut control circuit to be described late. The parallel circuit 12 establishes a delay circuit which is effective to keep the circuit free from malfunctions which would occur during transition of operation of the throttle switch 11. When the throttle switch 11 closes, the constant voltage V1 appears at the throttle switch second terminal to provide a signal A to the fuelcut control circuit with a delay, which is determined by the time constant ta of the parallel circuit 12, with respect to the closure of the throttle switch 11. Thus, the throttle position sensor 10 generates the signal A to the fuelcut control circuit when the throttle valve position is at an angle less than a predetermined value.

The gear position sensor 20 includes a plurality of gear switches 21–23 and 27–29 which are associated with a manual transmission (not shown but well known in the art) and adapted to close depending upon the driver's operation of the transmission shift lever to select one of the transmission gears. The gear switch 21 closes when the third forward speed gear is selected, the gear switch 22 closes when the fourth forward speed gear is selected, and the gear switch 23 closes when the fifth forward speed gear is selected. That is, any one of the gear switches 21–23 closes when the transmission is in high gear. The gear switches 21–23 are connected at their first terminals to the source of constant voltage V1, and at their second terminals to ground through a parallel circuit 24 of a resistor 25 and a capacitor 26 and also to a first input of an OR circuit 34. The parallel circuit 24 establishes a delay circuit which is effective to keep the circuit free from malfunctions which would occur during transition of operation of the gear switches 21–23. When any one of the gear switches 21–23 closes, the constant voltage V1 appears at its second terminal to provide a signal "b1" to the first input of the OR circuit 34 with a delay, which is determined by the time constant tb of the parallel circuit 24, with respect to the closure of the gear switch. The gear switch 27 closes when the reverse gear is selected, the gear switch 28 closes when the first forward speed gear is selected, and the gear switch 29 closes when the second forward speed gear is selected. That is, any one of the gear switches 27–29 will close if the transmission is in low gear. The gear switches 27–29 are connected at their first terminals to the source of constant voltage V1. The second terminals of the gear switches 27–29 are connected to ground through a parallel circuit 30 of a resistor 31 and a capacitor 32, to a second input of the OR circuit 34 through an inverter 33, and to a restart control circuit to be described later. The parallel circuit 30 establishes a delay circuit which is effective to keep the circuit free from malfunctions which would occur during transition of operation of the gear switches 27–29. When any one of the gear switch 27–29 closes, the constant voltage V1 appears at its second terminal to provide a signal C to the inverter 33 and also to the restart control circuit with a delay, which is determined by the time constant tc of the parallel circuit 30, with respect to the closure of the gear switch. The output of the inverter 33 goes low in the presence of the signal C and goes high to provide a signal "b2" to the second input of the OR circuit 34 in the absence of the signal C. The output of the OR circuit 34 goes high to provide a signal B to the fuelcut control circuit when it receives at its first input the signal "b1" or at its second input the signal "b2". When the transmission is neutral, the output of the inverter is high to generate the signal "b2" so as to cause the OR circuit 34 to generate the signal B since the gear switches 27–29 remain open and the inverter 33 does not receive the signal C. Thus, the gear position sensor 20 generates the signal B to the fuelcut control circuit only when the transmission is in high gear or in neutral, and generates the signal C to the restart control circuit only when the transmission is in low gear.

The clutch position sensor 40 includes a clutch switch 41 which is asociated with a clutch pedal (not shown but well known in the art) and adapted to close when the amount of the clutch pedal is depressed exceeds a predetermined value to disengage the clutch. The clutch switch 41 is connected at its first terminal to the source of constant voltage V1. The second terminal of the clutch switch 41 is connected to ground through a parallel circuit 42 of a resistor 43 and a capacitor 44 and also to the restart control circuit. The parallel circuit 42 establishes a delay circuit which is effective to keep the circuit free from malfunctions which would occur during transition of operation of the clutch switch 41. When the clutch switch 41 closes, the constant voltage V1 appears at the clutch switch second terminal to provide a signal D to the restart control circuit with a delay, which is determined by the time constant td of the parallel circuit 42, with respect to the closure of the clutch switch 41. Thus, the clutch position sensor 40 generates the signal D to the restart control circuit when the clutch is disengaged.

The engine speed sensor 50 includes an alternator 51 which is drivingly connected to an engine shaft (not shown) for generating a voltage signal proportional to the speed of rotation of the engine. The output of the alternator 51 is coupled through a resistor 52 to a negative input of a comparator 53. A pair of resistors 55 and 56 are connected in series between a source of constant voltage V2 and ground to form a voltage divider 54, the junction of the resistors 55 and 56 being connected to a positive input of the comparator 53. The value of the resistors 55 and 56 is chosen such that the reference voltage Va, which is presented to the positive input of the comparator 53, corresponds to a desired reference value of engine speed. Preferably, the engine speed reference value is somewhat less than engine idle speed. The output of the comparator 53 goes high to generator a signal E to the restart control circuit when the voltage at the negative input of the comparator is less than the reference voltage Va. Thus, the engine speed sensor 50 generates the signal E to the restart control circuit when the engine is operating at a speed less than a predetermined value. It is to be understood that the engine speed sensor is not limited to such structure employing an alternator. Alternatively, a crankshaft position sensor may be used.

The fuelcut control circuit, which is generally designated by reference numeral 60, includes an AND circuit 61 connected at its first input to the output of the delay circuit 12 of the throttle position sensor 10 and at its second input to the output of the OR circuit 34 of the gear position sensor 20. The output of the AND circuit 61 is connected through a resistor 62 to the base of a transistor 63 whose emitter is grounded. The collector of the transistor 63 is connected to a source of constant voltage V3 through a relay 64 which is associated with a fuelcut device such as, for example, a solenoid valve situated within a fuel conduit for blocking fuel flow to the engine when closed. For an automotive vehicle utilizing an electronic fuel control unit, the fuelcut device may block current flow through one or more injection nozzle coils.

When the AND circuit 61 receives at its first input the signal A from the throttle position sensor 10 and at its second input the signal B from the gear position sensor 20, the output of the AND circuit 61 goes high to generate a signal F. The signal F is supplied through the resistor 62 to render the transistor 63 conductive so as to energize the relay 64, causing the fuelcut device to terminate delivery of fuel to the engine. Thus, the fuelcut control circuit 60 terminates fuel delivery to the engine only when the two conditions are fulfilled, that is, when the throttle valve position is at an angle less than the predetermined value, and the transmission is in high gear or in neutral. If the two conditions are not achieved, the fuelcut control circuit 60 will resume fuel delivery to the engine.

The restart control circuit, which is generally designated by reference numeral 70, includes an AND circuit 71 connected at its first input to the output of the delay circuit 30 of the gear position sensor 20 and at its second input to the output of the delay circuit 42 of the clutch position sensor 40. The output of the AND circuit 71 is connected to a first input of another AND circuit 72 whose second input is connected to the output of the comparator 53 of the engine speed sensor 50. The output of the AND circuit 72 is connected through a resistor 73 to the base of a transistor 74 whose emitter is grounded. The collector of the transistor 74 is connected to a source of constant voltage V4 through a relay 75 associated with an engine restart device which may drive or actuate a starter (not shown but well known in the art) to restart the engine when the relay 75 is energized.

When the AND circuit 71 receives at its first input the signal C from the gear position sensor 20 and at its second input the signal D from the clutch position sensor 40, the output of the AND circuit 71 goes high to generate a signal G. When the AND circuit 72 receives at its first input the signal G from the AND circuit 71 and at its second input the signal E from the engine speed sensor 50, the output of the AND circuit 72 goes high to generate a signal H. The signal H is supplied through the resistor 73 to render the transistor 74 conductive so as to energize the relay 64, causing the restart device to restart the engine. Thus, the restart control circuit 70 restarts the engine only when the three conditions are fulfilled, that is, when the transmission is in low gear, the clutch is disengaged, and the engine is operating at a speed less than the predetermined value. If these three conditions are not achieved, the restart control circuit 70 will not restart the engine.

In operation, when the driver depresses the accelerator pedal to advance the throttle over the predetermined angle and turns the key switch into its start position with the transmission being held in neutral in order to start the engine, the throttle position sensor 10 terminates the generation of the signal A, the gear position sensor 20 generates the signal B, and the clutch position sensor 40 terminates the generation of the signal D. As a result, the output of the AND circuit 61 remains low to hold the transistor 63 in its non-conductive state and thus the relay 54 in its deenergized state. In this state of the circuit, the engine is supplied with fuel and driven by the starter. Consequently, the engine can start smoothly in the same manner as normal engines.

To start the vehicle from rest, the driver may depress the clutch pedal to disengage the clutch and operate the shift lever to select the first forward speed gear in the transmission. During these operation, the throttle switch 11 remains open to prevent the throttle sensor 10 from generating the signal A and the gear switch 28 is closed to prevent the gear position sensor 20 from generating the signal B. As a result, the fuelcut control circuit 60 cannot terminate fuel delivery to the engine. Also, the gear switch 28 is closed to permit the gear position sensor 20 to generate the signal C and the clutch switch 41 is closed to permit the clutch gear sensor 40 to generate the signal D. In addition, the engine speed sensor 50 does not generate the signal E since the engine is supplied with fuel and is operating at a speed more than the predetermined value. As a result, the restart control circuit 70 cannot restart the engine. Consequently, the vehicle can start smoothly without unnecessary engine restart in the same manner as normal engines.

To accelerate the vehicle thereafter, the driver may depress the clutch pedal and operate the shift lever to change the gear position from the second forward speed gear to the third forward speed gear. These operations cause neither fuelcut nor engine restart. Upon the depression of the clutch pedal with the transmission being held still in the second forward speed gear, the gear switch 29 remains closed to permit the gear position sensor 20 to generate the signal C and the clutch switch 41 closes to permit the clutch position sensor 40 to generate the signal D. However, the engine is operating at a speed more than the predetermined value and thus the engine speed sensor 50 cannot generate the signal E. As a result, the restart control circuit 70 cannot restart the engine. In the course of such gear position change, the transmission comes into neutral and the clutch pedal is released to cause the gear position sensor 20 to change its output from the signal C to the signal B and the throttle valve may move in a closing direction past the predetermined throttle angle to cause the throttle position sensor 10 to change its output to the signal A. However, the time constants ta and tc are suitably selected such as to hold the throttle and/or gear position sensor outputs unchanged for a time normally required for the driver to complete the gear position change. As a result, the fuelcut control circuit 60 cannot terminate fuel delivery to the engine. The same explanation may be applied for vehicle acceleration with the gear position being changed from the third forward speed gear to the fourth forward speed gear and also with the gear position being changed from the fourth forward speed gear to the fifth forward speed gear.

To decelerate the vehicle without operating the shift lever, the driver may release the accelerator pedal and depress the brake pedal. If the vehicle is decelerated in this manner when the transmission is in high gear, the fuelcut control circuit 60 will terminate fuel delivery to the engine since the throttle position sensor 10 generates the signal A and the gear position sensor 20 generates the signal B. If these conditions continue, the vehicle will come to a stop with the engine being held still. This can save fuel unnecessary during deceleration and also fuel required for a normal engine when the engine is idling during a wait for the traffic lights to change.

To accelerate the vehicle in the course of such vehicle deceleration, the driver may depress the accelerator pedal to advance the throttle valve over the predetermined angle. This causes the throttle position sensor 10 to terminate the generation of the signal A, thereby causing the fuelcut control circuit 60 to resume fuel delivery to the engine. Upon the resumption of the fuel delivery to the engine, the engine can restart smoothly by the aid of driving forces from the drive wheels since the transmission is held in high gear.

Alternatively, the vehicle may be decelerated by so-called engine brake or braking forces caused by loads created during the compression phase of engine operation. For this purpose, the driver operates the shift lever to change the gear position from the fifth forward speed gear to the fourth forward speed gear or from the fourth forward speed gear to the third forward speed gear. During this operation, the throttle position sensor 10 generates the signal A and the gear position sensor 20 generates the signal B, which causes the fuelcut control circuit 60 to terminates fuel delivery to the engine. This is effective to save more fuel than is possible for automobile vehicles having no circuit for terminating fuel delivery to the engine during deceleration.

If the driver operates the shift lever to change the gear position from the third forward speed gear to the second forward speed gear, the engine will be restarted a predetermined time after the selection of the second forward speed gear. That is, the gear position sensor 20 terminates the generation of the signal B, causing the fuelcut control circuit 60 to resume fuel delivery to the engine a predetermined time after the opening of the gear switch 21. In addition, the gear position sensor 20 generates the signal C a predetermined time after the closure of the gear switch 29, the clutch position sensor 40 generates the signal D a predetermined time after the closure of the clutch switch 41, and the engine speed sensor 50 generates the signal E since the fuelcut control circuit 60 has terminated fuel delivery to the engine when the third forward speed gear was selected and the engine comes to a stop due to loads created during the compression phase of engine operation upon the depression of the clutch pedal. In the presence of the three signals C, D and E, the restart control circuit 70 restarts the engine. Thus, the engine can be decelerated or accelerated again without impacts caused by driving forces from the drive wheels when the gear position is changed from a high gear to a low gear having a large gear ratio.

If the driver operates the shift lever to place the transmission in neutral and holds the accelerator pedal undepressed after the engine is decelerated with the second forward speed gear being selected until the vehicle comes to a stop, the fuelcut control circuit 60 will terminates fuel delivery to the engine. This is effective to save fuel required for a normal engine when the engine is idling during a wait for the traffic lights to change.

To start the vehicle from rest, the driver may depress the clutch pedal to disengage the clutch and operate the shift lever to select the first or second forward speed gear or the reverse gear. During these operations, the gear position sensor 20 terminates the generation of the signal B, causing the fuelcut control circuit 60 to resume fuel delivery to the engine and generates the signal C. In addition, the clutch position sensor 40 generates the signal D and the engine speed sensor 50 generates the signal E. As a result, the restart control circuit 70 restarts the engine. Thus, the vehicle can start smoothly from rest in the same manner as normal automotive vehicles having no circuit for terminating fuel delivery to the engine during deceleration.

Figure 2:
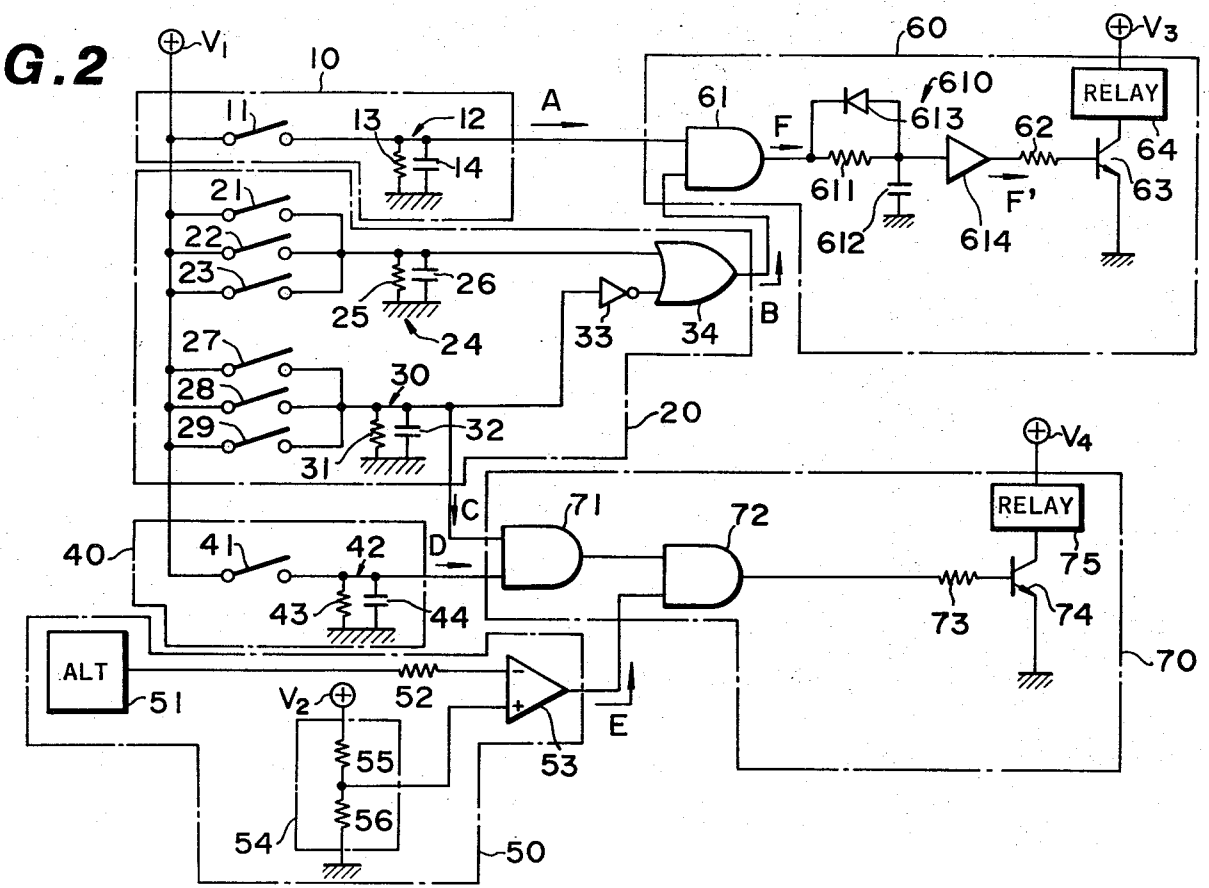
FIG. 2 is a circuit diagram showing a second embodiment of the present invention.

Referring now to FIG. 2, similar apparatus to that shown in FIG. 1 has been illustrated and similar parts have been given the same reference numeral. In the embodiment shown in FIG. 2, it will be seen that the fuelcut control circuit 60 includes a hold circuit 610 provided between the AND circuit 61 and the resistor 62 for holding the transistor 63 in its non-conductive state until the signal E from the AND circuit 61 continues over a predetermined time T. The hold circuit 610 includes a resistor 611 which is connected at its one end to the output of the AND circuit 61 and at the other end to ground through a capacitor 612. The resistor 611 and the capacitor 612 establish an integrating circuit having a time constant te determined by the values thereof. A diode 613 is connected in parallel with the resistor 611 in a polarity to permit current flow in a direction for discharging the capacitor 612. The junction of the resistor 611 and the capacitor 612 is connected to the resistor 62 through a buffer circuit 614. The output of the buffer circuit 614 goes high to produce a signal F′ when the voltage at its input exceeds a predetermined value Vb. Thus, the fuelcut control circuit 60 terminates fuel delivery to the engine when the two conditions continue over the predetermined time T determined by the time constant te, that is, the throttle valve position being at an angle less than a predetermined value to generate the signal A and the transmission being in high gear or in neutral to generate the signal B.

The operation is as follows: To start the engine, the driver may depress the accelerator pedal to advance the throttle over the predetermined angle and turn the key switch into its start position with the transmission being held in neutral. During these operations, the throttle position sensor 10 terminates the generation of the signal A, the gear position sensor 20 generates the signal B, and the clutch position sensor 40 terminates the generation of the signal D. In the absence of the signal A, the fuelcut control circuit 60 cannot terminate delivery of fuel to the engine. In the absence of the signal D, the restart control circuit 70 cannot restart the engine. In this state of the circuit, the engine is supplied with fuel and driven by the starter so that the engine can start smoothly in the same manner as normal engines.

Thereafter, the driver may depress the clutch pedal to disengage the clutch and operate the shift lever to select the first forward speed gear in the transmission in order to start the vehicle from rest. During these operations, the gear position sensor 20 generates the signal C, the clutch position sensor 40 generates the signal D, and the engine speed sensor 50 terminates the generation of the signal E since the engine is operating at a speed more than the reference value. In the absence of the signal B, the fuelcut control circuit 60 cannot terminate fuel delivery to the engine. The restart control circuit 70 restarts the engine only when the three conditions are fulfilled, that is, when the gear position sensor 20 generates the signal C, the clutch position sensor 40 generates the signal D, and the engine speed sensor 50 generates the signal E. In the absence of the signal E, the restart control circuit 70 cannot restart the engine. Consequently, the vehicle can start smoothly without unnecessary engine restart in the same manner as normal engines.

To accelerate the vehicle thereafter, the driver may depress the clutch pedal to disengage the clutch and operate the shift lever to change the gear position from the first forward speed gear to the second forward speed gear. In the course of such gear position change, the transmission comes into neutral and the clutch pedal is released to cause the gear position sensor 20 to change its output from the signal C to the signal B and the throttle valve may move in a closing direction past the predetermined throttle angle to cause throttle position sensor 10 to change its output to the signal A. However, the time constants ta and tc are properly selected such as to hold the throttle and/or gear position sensor outputs unchanged for a time normally required for the driver to complete the gear position change. Because of this, the fuelcut control circuit 60 cannot terminate fuel delivery to the engine. In addition, the restart control circuit 70 cannot restart the engine under these conditions.

Figure 3:
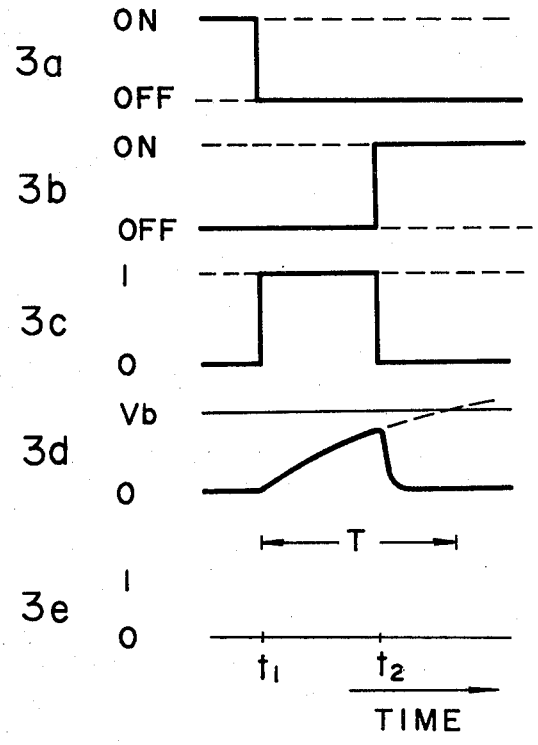
FIG. 3 contains five waveforms 3*a*, 3*b*, 3*c*, 3*d* and 3*e* obtained at various points in the circuit diagram of FIG. 2.

It is now assumed that the gear position change from the first forward speed gear to the second forward speed gear takes place slowly and takes a time longer than the time determined by the time constants ta and tc an that the gear switch 28 opens at time t1, as shown in FIG. 3*a*, and the gear switch 29 closes at time t2, as shown in FIG. 3*b*. The transmission is held in neutral for a time t2−t1 during which the gear position sensor 20 generates the signal B and the throttle position sensor 10 generates the signal A since the accelerator pedal is released during these operations. As a result, the output of the AND circuit 61 goes high to generate the signal E for the time t2−t1, as shown in FIG. 3*c*. The signal E is supplied through the integrating circuit to the buffer circuit 614. The voltage at the input of the buffer circuit 614, which varies as shown in FIG. 3*d*, cannot exceed the reference voltage Vb for the time t2−t1 which is less than the predetermined time T. Thus, the output of the buffer circuit 614 remains low to terminate the generation of the signal E′, as shown in FIG. 3*e*. As a result, the fuelcut control circuit 60 cannot terminate fuel delivery to the engine. This is effective to prevent impacts which would be caused by driving forces from the drive wheels when the transmission is in low gear, for example, in the second forward speed gear having a very large gear ratio.

For accelerating the vehicle, the driver may depress the clutch pedal and operate the shift lever to change the gear position from the second forward speed gear to the third forward spaced gear. These operations cause neither fuelcut nor engine restart. In the course of such gear position change, the transmission comes into neutral and the clutch pedal is released to cause the gear position sensor 20 to change its output from the signal C to the signal B and the throttle valve may move in a closing direction past the predetermined throttle angle to cause the throttle position sensor 10 to change its output to the signal A. However, the time constants ta and tc are suitably selected such as to hold the throttle and/or gear position sensor outputs unchanged for a time normally required for the driver to complete the gear position change. As a result, the fuelcut control circuit 60 cannot terminate fuel delivery to the engine. The restart control circuit 70 cannot restart the engine in the absence of the signal D. The same explanation may be applied for vehicle acceleration with the gear position being changed from the third forward speed gear to the fourth forward speed gear and also with the gear position being changed from the fourth forward speed gear to the fifth forward speed gear.

To decelerate the vehicle without operating the shift lever, the driver may release the accelerator pedal and depress the brake pedal. If the vehicle is decelerated in this manner when the transmission is in high gear, the throttle position sensor 10 generates the signal A and the gear position sensor 20 generates the signal B, causing the fuelcut control circuit 60 to terminate fuel delivery to the engine the predetermined time T after the AND circuit 61 generates the signal F in response to the occurrence of the signals A and B. If these conditions continue, the vehicle will come to a stop with the engine being said still. This can save fuel unnecessary during deceleration and also fuel required for a normal engine when the engine is idling during a wait for the traffic lights to change.

To accelerate the vehicle in the course of such vehicle deceleration, the driver may depress the accelerator pedal to advance the throttle valve over the predetermined angle. This causes the throttle position sensor 10 to terminate the generation of the signal A, thereby causing the fuelcut control circuit 60 to resume fuel delivery to the engine. Upon the resumption of the fuel delivery to the engine, the engine can restart smoothly by the aid of driving forces from the drive wheels since the transmission is held in high gear.

Alternatively, the vehicle may be decelerated by so-called engine brake or braking forces caused by loads created during the compression phase of engine operation. For this purpose, the driver operates the shift lever to change the gear position from the fifth forward speed gear to the fourth forward speed gear or from the fourth forward speed gear to the third forward speed gear. During this operation, the throttle position sensor 10 generates the signal A and the gear position sensor 20 generates the signal B, which causes the fuelcut control circuit 60 to terminate fuel delivery to the engine the predetermined time T after and AND circuit 61 generates the signal F in response to the occurrence of the signals A and B. This is effective to save more fuel than is possible for automotive vehicles having no circuit for terminating fuel delivery to the engine during deceleration.

If the driver operates the shift lever to change the gear position from the third forward speed gear to the second forward speed gear, the engine will be restarted. That is, the gear position sensor 20 terminates the generation of the signal B, causing the fuelcut control circuit to resume fuel delivery to the engine. In addition, the gear position sensor 20 generates the signal C, the clutch position sensor 40 generates the signal D, and the engine speed sensor 50 generates the signal E since the fuelcut control circuit 60 has terminated fuel delivery to the engine when the third forward speed gear was selected and the engine comes to a stop due to loads created during the compression phase of engine operation upon the depression of the clutch pedal. In the presence of the three signals C, D and E, the restart control circuit 70 restarts the engine. Thus, the engine can be decelerated or accelerated again without impacts caused by driving forces from the drive wheels when the gear position is changed from a high gear to a low gear having a larger gear ratio.

If the driver operates the shift lever to place the transmission is neutral and holds the accelerator pedal undepressed after the engine is decelerated with the second forward speed gear being selected until the vehicle comes to a stop, the fuelcut control circuit 60 will terminate fuel delivery to the engine the predetermined time T after the AND circuit 61 generates the signal F in response to the occurrence of the signals A and B. This is effective to save fuel required for a normal engine when the engine is idling during a wait for the traffic lights to change.

To start the vehicle from rest, the driver may depress the clutch pedal to disengage the clutch and operate the shift lever to select the first or second forward speed gear or the reverse gear. During these operations, the gear position sensor 20 terminates the generation of the signal B, causing the fuelcut control circuit 60 to resume fuel delivery to the engine and generates the signal C. In addition, the clutch position sensor 40 generates the signal D and the engine speed sensor 50 generates the signal E. As a result, the restart control circuit 70 restarts the engine. Thus, the vehicle can start smoothly from rest in the same manner as normal automotive vehicles having no circuit for terminating fuel delivery to the engine during deceleration.

Figure 4:
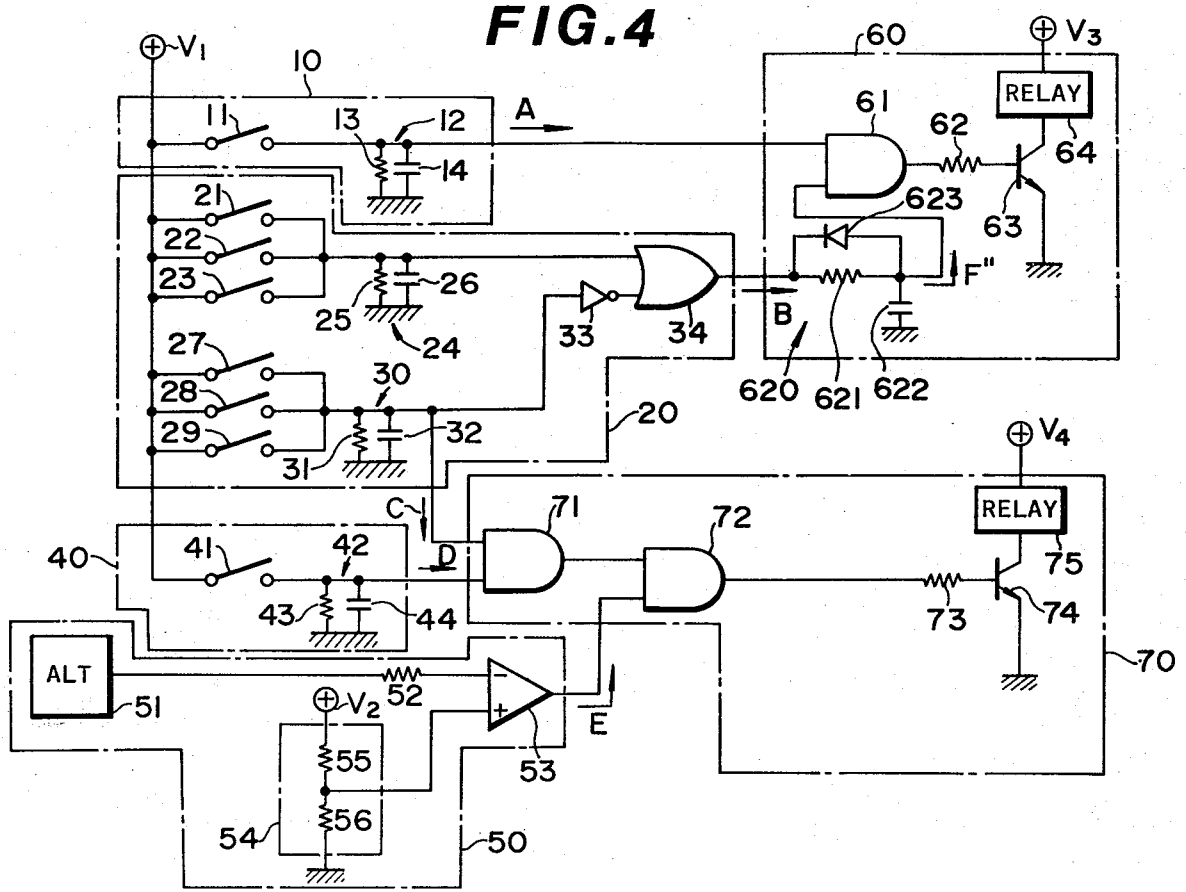
FIG. 4 is a circuit diagram showing a third embodiment of the present invention.

Referring now to FIG. 4, similar apparatus to that shown in FIG. 1 has been illustrated and similar parts have been given the same reference numeral. In the embodiment shown in FIG. 4, it will be seen that the fuel control circuit 60 includes a hold circuit 620 provided between the OR circuit 34 and the second input of the AND circuit 61 for holding the output of the AND circuit 61 low until the signal B from the OR circuit 34 continues over a predetermined time T in the presence of the signal A from the throttle position sensor 10. The hold circuit 620 includes a resistor 621 which is connected at its one end to the output of the OR circuit 34 and at the other end to ground through a capacitor 622. The resistor 621 and the capacitor 622 establish an integrating circuit having a time constant tf determined by the values thereof. A diode 623 is connected in parallel with the resistor 621 in a polarity to permit current flow in a direction for discharging the capacitor 622. The junction of the resistor 621 and the capacitor 622 is connected to the second input of the AND circuit 61. The output of the hold circuit 620 goes high to produce a signal F″ only when the signal B continues over the predetermined time T determined by the time constant tf of the integrating circuit. Thus, the fuelcut control circuit 60 terminates fuel delivery to the engine when the two conditions are fulfilled, that is, when the throttle valve position being at an angle less than a predetermined value to cause the throttle position sensor 10 to generate the signal A and the transmission is held in high gear or in neutral to cause the gear position sensor 20 to generate the signal B for a time longer than the predetermined time T.

The operation is as follows: To start the engine, the driver may depress the accelerator pedal to advance the throttle over the predetermined angle and turn the key switch into its start position with the transmission being held in neutral. During these operations, the throttle position sensor 10 terminates the generation of the signal A, the gear position sensor 20 generates the signal B, and the clutch position sensor 40 terminates the generation of the signal D. In the absence of the signal A, the fuelcut control circuit 60 cannot terminate delivery of fuel to the engine. In the absence of the signal D, the restart control circuit 70 cannot restart the engine. Because of this, the engine is supplied with fuel and driven by the starter so that the engine can start smoothly in the same manner as normal engines.

To start the vehicle from rest thereafter, the driver may depress the clutch pedal to disengage the clutch and operate the shift lever to select the first forward speed gear in the transmission. During these operations, the gear position sensor 20 generates the signal C, the clutch position sensor 40 generates the signal D, and the engine speed sensor 50 terminates the generation of the signal E since the engine is operating at speeds more than the reference value. In the absence of the signal B, the fuelcut control circuit 60 cannot terminate fuel delivery to the engine. The restart control circuit 70 restarts the engine only when the three conditions are fulfilled, that is, when the gear position sensor 20 generates the signal C, the clutch position sensor 40 generates the signal D, and the engine speed sensor 50 generates the signal E. In the absence of the signal E, the restart control circuit 70 cannot restart the engine. Consequently, the vehicle can start smoothly without unnecessary engine restart in the same manner as normal engines.

To accelerate the vehicle thereafter, the driver may depress the clutch pedal to disengage the clutch and operate the shift lever to change the gear position from the first forward speed gear to the second forward speed gear. In the course of such gear position change, the transmission comes into neutral and the clutch pedal is released to cause the gear position sensor 20 to change its output from the signal C to the signal B and the throttle valve may move in a closing direction past the predetermined throttle angle to cause throttle position sensor 10 to change its output to the signal A. However, the time constants ta and tc are properly selected such as to hold the throttle and/or gear position sensor outputs unchanged for a time normally required for the driver to complete the gear position change. Because of this, the fuelcut control circuit 60 cannot terminate fuel delivery to the engine. In addition, the restart control circuit 70 cannot restart the engine under these conditions.

Figure 5:
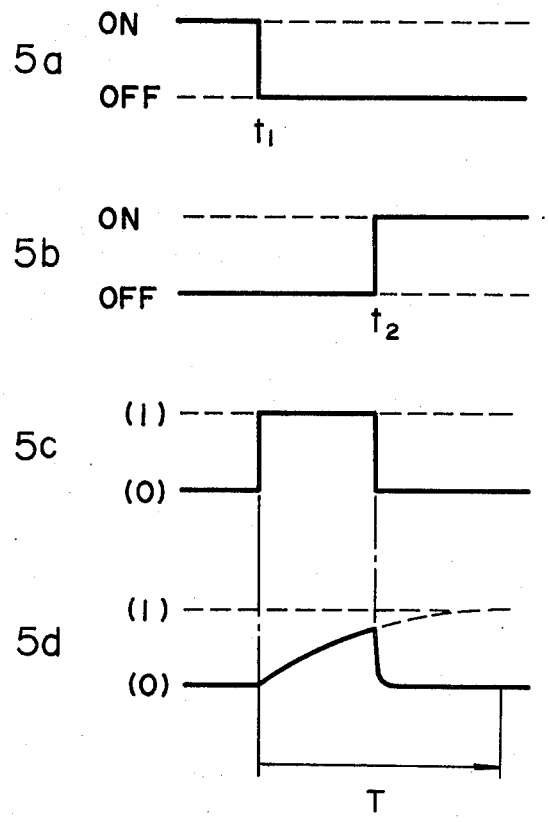
FIG. 5 contains four waveforms 5*a*, 5*b*, 5*c* and 5*d* obtained at various points in the circuit diagram of FIG. 4.

It is now assumed that the gear position change from the first forward speed gear to the second forward speed gear takes place slowly and takes a time longer than the time determined by the time constant ta and tc and that the gear switch 28 opens at time t1, as shown in FIG. 5*a*, and the gear switch 29 closes at time t2, as shown in FIG. 5*b*. The transmission is held in neutral for a time t2−t1 during which the output of the OR circuit 34 goes high, as shown in FIG. 5*c*, to provide the signal B to the hold circuit 620. The output of the hold circuit 620, which varies as shown in FIG. 5*d*, cannot go high to generate the signal F″ for a time shorter than the predetermined time after the output of the OR circuit 34 changes to its high level. Because of this, the fuelcut control circuit 60 cannot terminate fuel delivery to the engine if the gear position change takes place in a time shorter than the time determined by the time constants ta and tc plus the predetermined time T. This is effective to prevent impacts which would be caused by driving forces from the drive wheels when the transmission is in low gear, for example, in the second forward speed gear having a very large gear ratio.

For accelerating the vehicle, the driver may depress the clutch pedal and operate the shift lever to change the gear position from the second forward speed gear to the third forward spaced gear. These operations cause neither fuelcut nor engine restart. In the course of such gear position change, the transmission comes into neutral and the clutch pedal is released to cause the gear position sensor 20 to change its output from the signal C to the signal B and the throttle valve may move in a closing direction past the predetermined throttle angle to cause the throttle position sensor 10 to change its output to the signal A. However, the time constants ta and tc are properly selected such as to hold the throttle and/or gear position sensor outputs unchanged for a time normally required for the driver to complete the gear position change. As a result, the fuelcut control circuit 60 cannot terminate fuel delivery to the engine. The restart control circuit 70 cannot restart the engine in the absence of the signal D. The same explanation may be applied for vehicle acceleration with the gear position being changed from the third forward speed gear of the fourth forward speed gear and also with the gear position being changed from the fourth forward speed gear to the fifth forward speed gear.

To decelerate the vehicle without operating the shift lever, the driver may release the accelerator pedal and depress the brake pedal. If the vehicle is decelerated in this manner with the transmission being held in high gear, the fuelcut control circuit 60 terminates fuel delivery to the engine rapidly, that is, substantially at the same time the throttle position sensor 20 generates the signal A, since the signal B has already occurred before these operations. If these conditions continue, the vehicle will come to a stop with the engine being held still. This can save fuel unnecessary during deceleration and also fuel required for a normal engine when the engine is idling during a wait for the traffic light to change.

To accelerate the vehicle in the course of such vehicle deceleration, the driver may depress the accelerator pedal to advance the throttle valve over the predetermined angle. This causes the throttle position sensor 10 to terminate the generation of the signal A, thereby causing the fuelcut control circuit 60 to resume fuel delivery to the engine. Upon the resumption of the fuel delivery to the engine, the engine can restart smoothly by the aid of driving forces from the drive wheels since the transmission is held in high gear.

Alternatively, the vehicle may be decelerated by so-called engine brake or braking forces caused by loads created during the compression phase of engine operation. For this purpose, the driver operates the shift lever to change the gear position from the fifth forward speed gear to the fourth forward speed gear or from the fourth forward speed gear to the third forward speed gear. During this operation, the throttle position sensor 10 generates and the gear position sensor 20 generates the signal B, which causes the fuelcut control circuit 60 to terminate fuel delivery to the engine a predetermined time determined by the time constant ta after the throttle switch closes since the signal B has already occurred before this operation. This is effective to save more fuel than is possible for automotive vehicles having no circuit for terminating fuel delivery to the engine during deceleration.

If the driver operates the shift lever to change the gear position from the third forward speed gear to the second forward speed gear, the engine will be restarted. That is, the gear position sensor 20 terminates the generation of the signal B, causing the fuelcut control circuit to resume fuel delivery to the engine. In addition, the gear position sensor 20 generates the signal C, the clutch position sensor 40 generates the signal D, and the engine speed sensor 50 generates the signal E since the fuelcut control circuit 60 has terminated fuel delivery to the engine when the third forward speed gear was selected and the engine comes to a stop due to loads created during the compression phase of engine operation upon the depression of the clutch pedal. In the presence of the three signals C, D and E, the restart control circuit 70 restarts the engine. Thus, the engine can be decelerated or accelerated again without impacts caused by driving forces from the drive wheels when the gear position is changed from a high gear to a low gear having a larger gear ratio.

If the driver operates the shift lever to place the transmission in neutral and holds the accelerator pedal undepressed after the engine is decelerated with the second forward speed gear being selected until the vehicle comes to a stop, the fuelcut control circuit 60 will terminate fuel delivery to the engine the predetermined time T after the generation of the signal B. This is effective to save fuel required for a normal engine when the engine is idling during a wait for the traffic lights to change.

To start the vehicle from rest, the driver may depress the clutch pedal to disengage the clutch and operate the shift lever to select the first or second forward speed gear or the reverse gear. During these operations, the gear position sensor 20 terminates the generation of the signal B, causing the fuelcut control circuit 60 to resume fuel delivery to the engine and generates the signal C. In addition, the clutch position sensor 40 generates the signal D and the engine speed sensor 50 generates the signal E. As a result, the restart control circuit 70 restarts the engine. Consequently, the vehicle can start smoothly from rest in the same manner as normal automotive vehicles having no circuit for terminating fuel delivery to the engine during deceleration.

Figure 6:
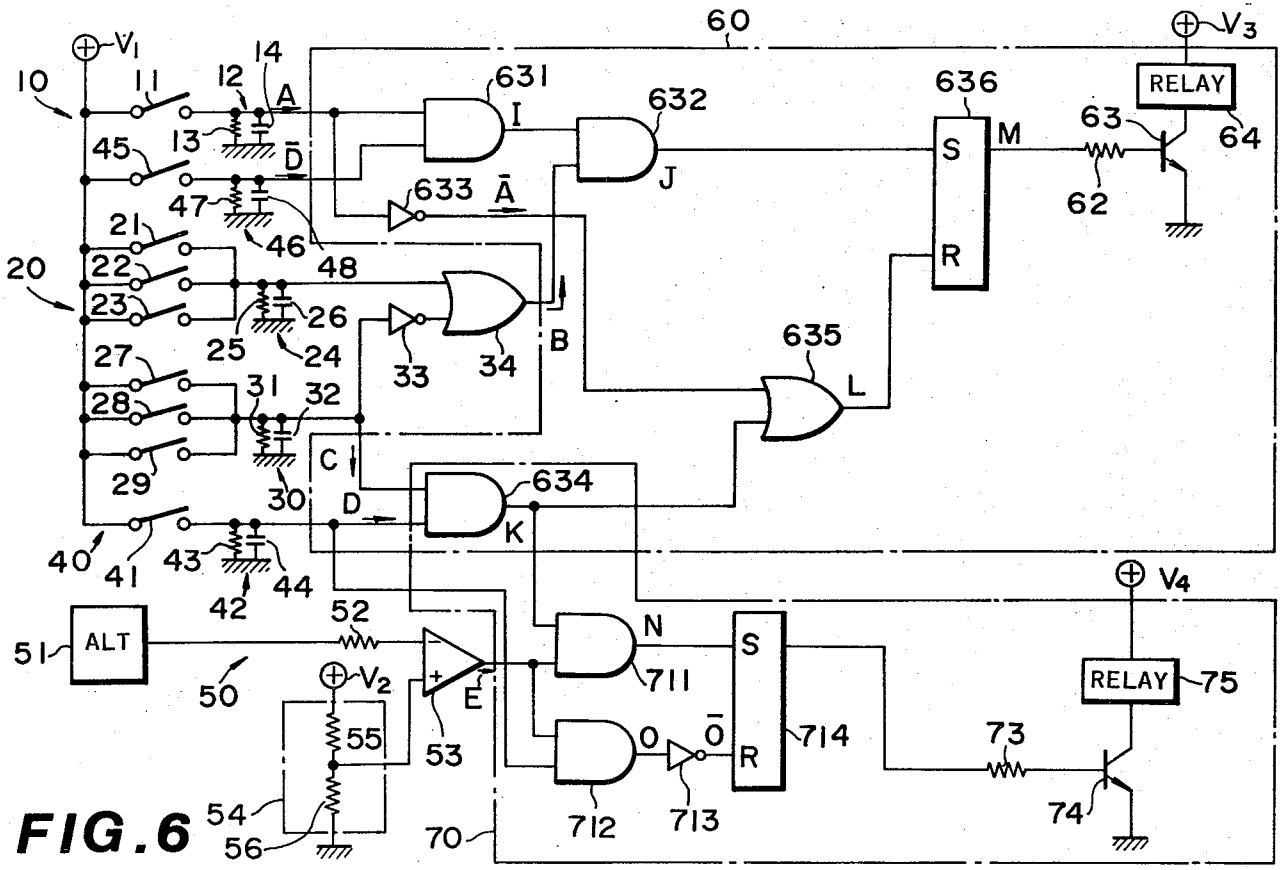
FIG. 6 is a circuit diagram showing a fourth embodiment of the present invention.

Referring now to FIG. 6, there is illustrated another embodiment of the present invention. Parts which ar like those in FIG. 1 have been given the same reference numeral. In the embodiment shown in FIG. 6, the clutch position sensor 40 further includes a second clutch switch 45 which is associated with the clutch pedal such that it closes when the clutch is engaged. The second clutch switch 45 is connected as its first terminal to the source of constant voltage V1. The second terminal of the second clutch switch 45 is connected to ground through a parallel circuit 46 of a resistor 47 and a capacitor 48 and also to the fuelcut control circuit 60. The parallel circuit 46 establishes a delay circuit which is effective to keep the circuit free from malfunctions which would occur during transition of operation of the second clutch switch 45. When the clutch switch 45 closes, the constant voltage V1 appears at the second clutch switch second terminal to provide a signal $\overline{D}$ to the fuelcut control circuit 60 with a delay, which is determined by the time constant tg of the parallel circuit 46, with respect to the closure of the second clutch switch 45. Thus, the clutch position sensor 40 generates the signal D to the restart control circuit 70 when the clutch is disengaged and also the signal $\overline{D}$ to the fuelcut control circuit 60 when the clutch is engaged.

The fuelcut control circuit 60 includes an AND circuit 631 connected at its first input to the output of the delay circuit 12 of the throttle position sensor 10 and at its second input to the output of the delay circuit 46 of the clutch position sensor 40. The output of the AND circuit 631 is connected to a first input of another AND circuit 632 whose second input is connected to the output of the OR circuit 34 of the gear position sensor 20. The fuelcut control circuit 60 also includes another AND circuit 634 having a first input connected to the delay circuit 30 of the gear position sensor 20 and a second input connected to the delay circuit 41 of the clutch position circuit 40. The output of the AND circuit 634 is connected to a second input of an OR circuit 635 whose first input is connected through an inverter 633 to the delay circuit 12 of the throttle position sensor 10. The output of the AND circuit 632 is connected to the set input of a flip-flop 636 whose reset input is connected to the output of the OR circuit 635. The output of the flip-flop 636 is connected through the resistor 62 to the base of the transistor 63.

When the AND circuit 631 receives at its first input the signal A from the throttle position sensor 10 and at its second input the signal $\overline{D}$ from the clutch position sensor 40, the output of the AND circuit 631 goes high to generate a signal I. When the AND circuit 632 receives at its first input the signal I from the AND circuit 631 and at its second input the signal B from the gear position sensor 20, the output of the AND circuit 632 goes high to generate a signal J. The output J is supplied to the set input S of the flip-flop 636 which thereby switches to its second stable state and thus provides a signal M. The signal M is supplied through the resistor 62 to render the transistor 63 conductive so as to energize the relay 64, causing the fuelcut device to terminate delivery of fuel to the engine. When the throttle valve 11 opens, the output of the inverter 633 goes high to generate signal $\overline{A}$. The output of the AND circuit 634 goes high to generate a signal K when the AND circuit 634 receives at its first input the signal C from the gear position sensor 20 and at its second input the signal D from the clutch position sensor 40. In the presence of the signal $\overline{A}$ or K, the output of the OR circuit 635 gear high to generate a signal L. The signal L is supplied to the reset input R of the flip-flop 636 which thereby returns to its first stable state and thus terminates the generation of the signal M, causing resumption of fuel delivery to the engine.

Thus, the fuelcut control circuit 60 terminates fuel delivery to the engine when the three conditions are fulfilled, that is, when the throttle valve position is at an angle less than a predetermined value to generate the signal A, the clutch is engaged to generate the signal $\overline{D}$, and the transmission is in high gear or in neutral to generate the signal B. The fuelcut control circuit 60 resumes fuel delivery in the engine throttle valve position is at an angle more than the predetermined value to generate the signal $\overline{A}$ or when the transmission is in low gear to generate the signal C and the clutch is disengaged to generate the signal D.

The restart control circuit 70 includes AND circuits 711 and 712. The AND circuit 711 is connected at its first input to the output of the AND circuit 634 and at its second input to the output of the engine speed sensor 50. The output of the AND circuit is connected to the set input S of a flip-flop 714. The AND circuit 712 is connected at its first input to the output of the engine speed sensor 50 and at its second input to the output of the delay circuit 42 of the clutch position sensor 40. The output of the AND circuit 712 is connected through an inverter 713 to the reset input R of the flip-flop 714. The output of the flip-flop 714 is connected through the resistor 73 to the base of the transistor 74.

When the AND circuit 634 receives at its first input the signal C from the gear position sensor 20 and at its second input the signal D from the clutch position sensor 20, the output of the AND circuit 634 goes high to generate the signal K. The output of the AND circuit 711 goes high to generate the signal N when it receives at its first input the signal K from the AND circuit 634 and at its second input the signal E from the engine speed sensor 50. The signal N is supplied to the set terminal S of the flip-flop 714 which thereby switches to its second stable state and thus provides a signal P. The signal P is supplied through the resistor 73 to render the transistor 74 conductive so as to energize the relay 75, causing the restart device to restart the engine. When the AND circuit 712 receives at its first input the signal E from the engine speed sensor 50 and at its second input the signal D from the clutch position sensor 40, the output of the AND circuit 712 goes high to generate a signal 0. The signal 0 is supplied to the inverter 713 which thereby generates a low output. The output of the inverter goes high to generate the signal $\overline{0}$ when the AND circuit 712 terminates the generation of the signal 0, that is, when the engine speed sensor 50 terminates the generation of the signal E and/or when the clutch position sensor 40 terminates the generation of the signal D. The signal $\overline{0}$ is supplied to the reset input R of the flip-flop 713 which thereby returns to its first stable state and thus terminates the generation of the signal P, causing the restart device to stop restarting the engine.

Thus, the restart control circuit 70 restarts the engine when the three conditions are fulfilled, that is, when the transmission is in low gear to generate the signal C, the clutch is disengaged to generate the signal D, and the engine is operating at a speed less than the predetermined value. The restart control circuit 70 stops restarting the engine when the engine speed exceeds the predetermined value and/or when the clutch is engaged.

The operation is as follows: To start the engine, the driver may depress the accelerator pedal to advance the throttle over the predetermined angle and turn the key switch into its start position with the transmission being held in neutral. During these operations, the throttle position sensor 10 terminates the generation of the signal A, the gear position sensor 20 generates the signal B, and the clutch position sensor 40 terminates the generation of the signal D. In the absence of the signal A, the fuelcut control circuit 60 cannot terminate delivery of fuel to the engine. In the absence of the signal D, the restart control circuit 70 cannot restart the engine. Thus, the engine is supplied with fuel and driven by the starter so that the engine can start smoothly in the same manner as normal engines.

To start the vehicle from rest, the driver may depress the clutch pedal to disengage the clutch and operate the shift lever to select the first forward speed gear in the transmission. During these operations, the gear position sensor 20 generates the signal C, the clutch position sensor 40 generates the signal D, and the engine speed sensor 50 terminates the generation of the signal E since the engine is operating at a speed more than the predetermined value. In the absence of the signals B and D, the fuelcut control circuit 60 cannot terminate fuel delivery to the engine. Additionally, the restart control circuit 70 cannot restart the engine in the absence of the signal E. Consequently, the vehicle can start smoothly without unnecessary engine restart in the same manner as normal engines.

To accelerate the vehicle thereafter, the driver may depress the clutch pedal to disengage the clutch, operate the shift lever to change the gear position from the first forward speed gear to the second forward speed gear to the second forward speed gear, and then depress the accelerator pedal. During these conditions, the fuelcut control circuit 60 cannot terminate fuel delivery to the engine since the transmission is neither in high gear nor in neutral and the gear position sensor 20 does not generate the signal B. In addition, the restart control circuit 70 cannot restart the engine since the engine is operating at a speed more than the predetermined value and the engine speed sensor 50 does not generate the signal E.

If the gear position change takes place slowly and takes a time longer than the time determined by the time constants tc and td of the respective delay circuits 30 and 42, the gear position sensor 20 will generate the signal C and the clutch position sensor 40 will generate the signal D. This would cause the restart control circuit 70 to restart the engine if the engine speed falls below the predetermined value. Under these conditions, however, the signals A, $\overline{D}$, and B will occur to cause the fuelcut control circuit 70 to terminate fuel delivery to the engine. This prevents the restart device such as the starter motor from operating while the engine is operating and keeps the starter motor from failure.

For accelerating the vehicle, the driver may depress the clutch pedal and operate the shift lever to change the gear position from the second forward speed gear to the third forward speed gear. These operations cause neither fuelcut nor engine restart. In the course of such gear position change, the transmission comes into neutral and the clutch pedal is released to engage the clutch to cause the gear position sensor 20 to change its output from the signal C to the signal B and the clutch position sensor 20 to change its output from the signal D to the signal $\overline{D}$, and the throttle valve may move in a closing direction past the predetermined throttle angle to cause the throttle position sensor 10 to change its output to the signal A. However, the time constants ta, tc and tg are properly selected such as to hold the throttle, gear and/or clutch position sensor outputs unchanged for a time normally required for the driver to complete the gear position change. As a result, the fuelcut control circuit 60 cannot terminate fuel delivery to the engine. The restart control circuit 70 cannot restart the engine in the absence of the signal D. The same explanation may be applied for vehicle acceleration with the gear position being changed from the third forward speed gear to the fourth forward speed gear and also with the gear position being changed from the fourth forward speed gear to the fifth forward speed gear.

To decelerate the vehicle, the driver may release the accelerator pedal and depress the brake pedal. If the vehicle is decelerated in this manner with the transmission being held in high gear, the fuelcut control circuit 60 terminates fuel delivery to the engine since the throttle position sensor 10 generates the signal A, the gear position sensor 20 generates the signal B, and the clutch position sensor 40 generates the signal $\overline{D}$. This can save fuel unnecessary during deceleration and enhance the efficiency of engine brake or braking forces caused by load created during the compression phase of engine operation.

The vehicle may be accelerated in the course of such vehicle deceleration by depressing the clutch pedal to disengage the clutch and operating the shift lever to place the transmission into a low gear, or by depressing the accelerator pedal to advance the throttle valve over the predetermined angle. During these operations, the clutch position sensor 40 generates the signal D and the gear position sensor 20 generates the signal C to cause the AND circuit 634 to generate the signal K, or the throttle position sensor 10 terminates the signal A to cause the inverter 633 to generate the signal $\overline{A}$. As a result, the output of the OR circuit 635 goes high to reset the flip-flop 636, causing the fuelcut control circuit 60 to resume fuel delivery to the engine.

If the engine is operating at a speed less than the predetermined value under these conditions, the restart control circuit 70 will restart the engine when the driver operates the shift lever to place the transmission in a low gear and depresses the clutch pedal to disengage the clutch. Alternatively, if the engine is operating at a speed more than the predetermined value under these conditions, the restart control circuit 70 cannot restart the engine although the engine is started by driving forces from the drive wheels. Thus, the engine can be restarted smoothly without impacts since it is restarted by the restart device such as a starter motor when the transmission is in a low gear having a large gear ratio and by driving forces from the drive wheels when the transmission is in a high gear having a small gear ratio.

Thereafter, the fuelcut control circuit 70 disables the restart device to stop restarting the engine when the engine speed exceeds over the predetermined value to cause the engine speed sensor 50 to terminate the generation of the signal E and/or the clutch pedal is released to engage the clutch to cause the clutch position sensor 40 to terminate the generation of the signal D. This prevents the starter motor from operating while the engine is operating and keeps the starter motor from failure.

When the vehicle is at rest, the transmission is held in neutral, the clutch pedal is released to engage the clutch, and the accelerator pedal is released. Thus, the fuelcut control circuit 60 terminates fuel delivery to the engine in the presence of the signals A, B, and $\overline{D}$. The vehicle can be started from rest by depressing the clutch pedal to disengage the clutch and operating the shift lever to select a low gear as described hereinbefore.

Figure 7:
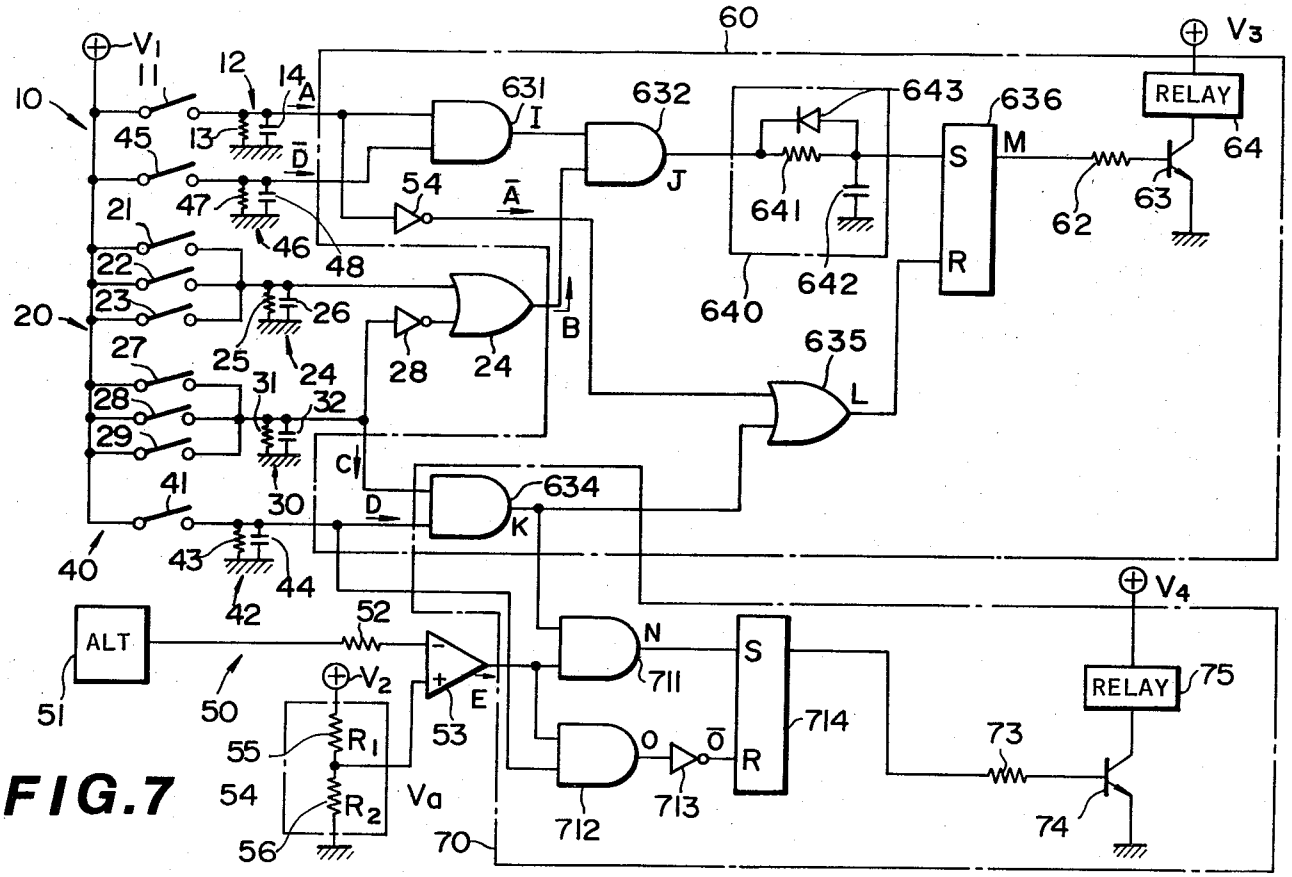
FIG. 7 is a circuit diagram showing a fifth embodiment of the present invention.

Referring now to FIG. 7, similar apparatus to that shown in FIG. 6 has been illustrated and similar parts have been given the same reference numeral. In the embodiment shown in FIG. 7, it will be seen that the fuelcut control circuit 60 includes a hold circuit 640 provided between the output of the AND circuit 632 and the set input S of the flip-flop 636. The hold circuit 640 includes a resistor 641 which is connected at its one end to the output of the AND circuit 632 and at the other end to ground through a capacitor 642. The resistor 641 and the capacitor 642 establish an integrating circuit having a time constant the determined by the values thereof. A diode 643 is connected in parallel with the resistor 641 in a polarity to permit current flow in a direction for discharging the capacitor 642. The junction of the resistor 641 and the capacitor 642 is connected to the set input of the flip-flop 636. The output of the hold circuit 640 goes high to switch the flip-flop 636 into its second stable state when the signal J from the AND circuit 632 continues over a predetermined time T determined by the time constant th of the integrating circuit. Thus, the fuelcut control circuit 60 terminates fuel delivery to the engine when the three conditions continue over the predetermined time T, that is, when the throttle valve position is at an angle less than a predetermined value to cause the throttle position sensor 10 to generate the signal A, the clutch is engaged to cause the clutch position sensor 40 to generate the signal $\overline{D}$, and the transmission is in high gear or in neutral to cause the gear position sensor 20 to generate the signal B.

Figure 8:
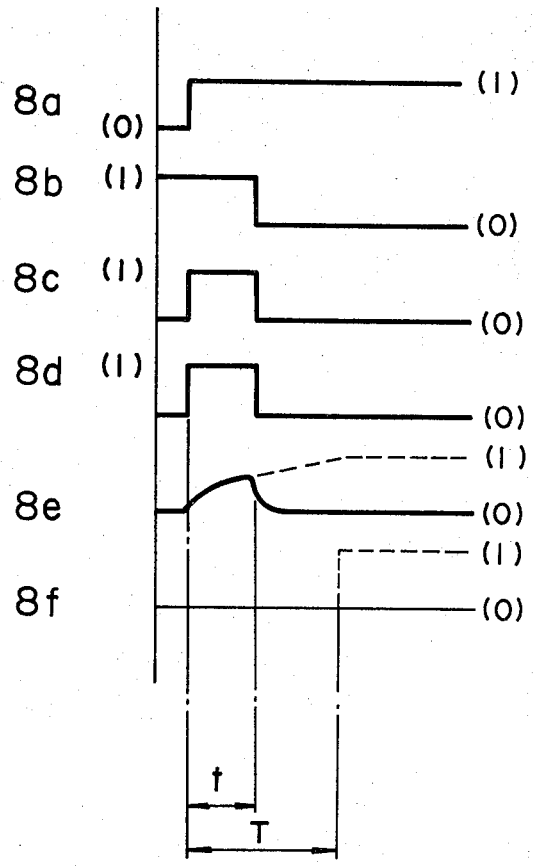
FIG. 8 contains six waveforms 8*a*, 8*b*, 8*c*, 8*d*, 8*e* and 8*f* obtained at various points in the circuit diagram of FIG. 7.
Figure 9:
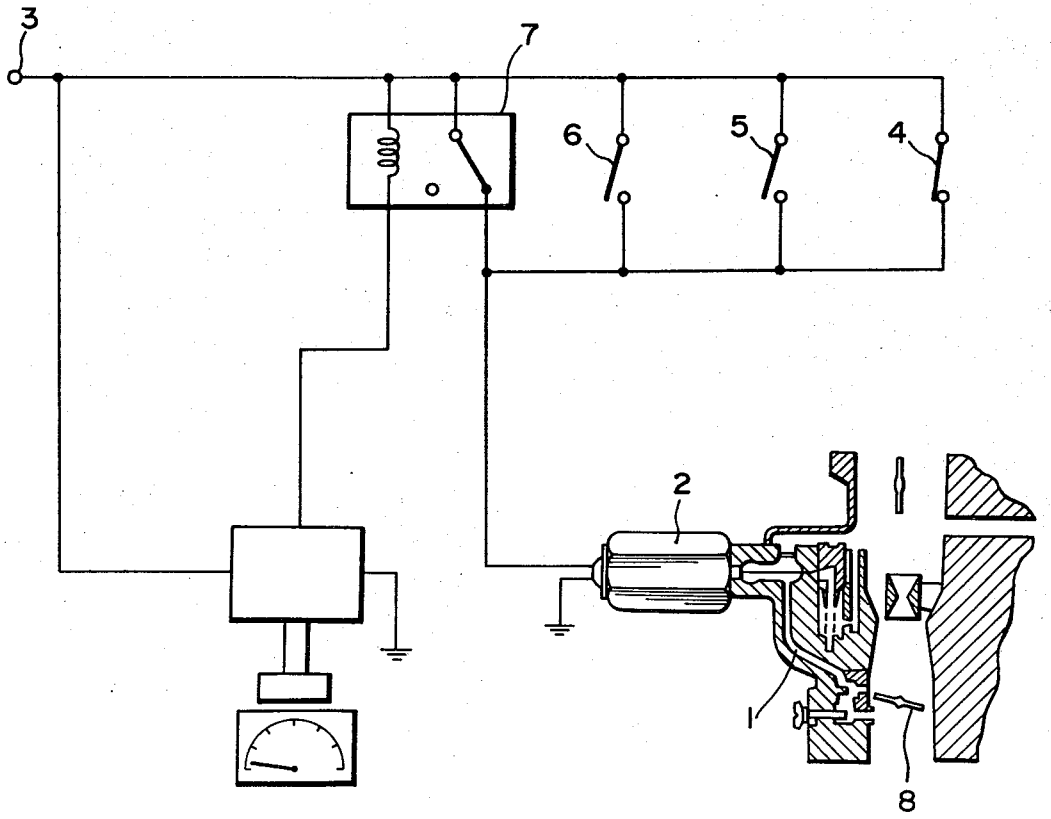
FIG.9 PRIOR ART
FIG. 9 is a circuit diagram showing a conventional engine control circuit.

Referring to FIG. 8, the fuelcut control circuit 60 will be described further. Assuming now that the throttle position sensor 10 generates the signal A at time t1, as shown in FIG. 8*a*, and the clutch position sensor 40 terminates the generation of the signal $\overline{D}$ at time t2, as shown in FIG. 8*b*, the output of the AND circuit 631 will go high at time t1 and go low at time t2 to generate the signal I for the time $t=t2-t1$, as shown in FIG. 8*c*. If the gear position sensor 20 generates the signal B for the time t, the output of the AND circuit 632 will go high at time t1 and go low at time t2 to generate the signal J for the time t, as shown in FIG. 8*d*. The signal J is supplied to the hold circuit 640. The output of the hold circuit 640, which varies as shown in FIG. 8*e*, cannot go high to generate the set signal to the flip-flop 636 for the time t which is shorter than the predetermined time T. The hold circuit 640 can generate the set signal to the flip-flop 636 only when the signal J continues over the predetermined time T, as shown in broken lines of FIGS. 8*e* and 8*f*.

The operation is as follows: To start the engine, the driver may depress the accelerator pedal to advance the throttle over the predetermined angle and turn the key switch into its start position with the transmission being held in neutral. During these operations, the throttle position sensor 10 terminates the generation of the signal A, the gear position sensor 20 generates the signal B, and the clutch position sensor 40 terminates the generation of the signal D. In the absence of the signal A, the fuelcut control circuit 60 cannot terminate delivery of fuel to the engine. In the absence of the signal D, the restart control circuit 70 cannot restart the engine. Thus, the engine is supplied with fuel and driven by the starter so that the engine can start smoothly in the same manner as normal engines.

To start the vehicle from rest, the driver may depress the clutch pedal to disengage the clutch and operate the shift lever to select the first forward speed gear in the transmission. During these operations, the gear position sensor 20 generates the signal C, the clutch position sensor 40 generates the signal D, and the engine speed sensor 50 terminates the generation of the signal E since the engine is operating at a speed more than the predetermined value. In the absence of the signals B and D, the fuelcut control circuit 60 cannot terminate fuel delivery to the engine. Additionally, the restart control circuit 70 cannot restart the engine in the absence of the signal E. Consequently, the vehicle can start smoothly without unnecessary engine restart in the same manner as normal engines.

To accelerate the vehicle thereafter, the driver may depress the clutch pedal to disengage the clutch, operate the shift lever to change the gear position from the first forward speed gear to the second forward speed gear, and then depress the accelerator pedal. During these conditions, the fuelcut control circuit 60 cannot terminate fuel delivery to the engine since the transmission is neither in high near nor in neutral and the gear position sensor 20 does not generate the signal B. In addition, the restart control circuit 70 cannot restart the engine since the engine is operating at a speed more than the predetermined value and the engine speed sensor 50 does not generate the signal E.

If the gear position change takes place slowly and takes a time longer than the time determined by the time constants ta, tb, tc and tg of the respective delay circuits 12, 24, 30 and 46, the three conditions will be achieved, that is, when the throttle valve position is at an angle less than the predetermined value, the clutch is engaged, and the transmission is in neutral, causing the output of the AND circuit 632 to go high to generate the signal J. However, the hold circuit 640 holds its output low so as not to generate a set signal to the flip-flop 636 until the signal J continues over the predetermined time T. Because of this, the fuelcut control circuit 60 cannot terminate fuel delivery to the engine if the gear position change takes place in a time shorter than the time determined by the time constants ta, tb, tc and tg plus the predetermined time T.

For accelerating the vehicle, the driver may depress the clutch pedal and operate the shift lever to change the gear position from the second forward speed gear to the third forward speed gear. These operations cause neither fuelcut nor engine restart. In the course of such gear position change, the transmission comes into neutral and the clutch pedal is released to engage the clutch to cause the gear position sensor 20 to change its output from the signal C to the signal B and the clutch position sensor 20 to change its output from the signal D to the signal $\overline{D}$, and the throttle valve may move in a closing direction past the predetermined throttle angle to cause the throttle position sensor 10 to change its output to the signal A. However, the fuelcut control circuit 60 cannot terminate fuel delivery to the engine by the provision of the delay circuits 12, 24, 30 and 46 and the hold circuit 640.

To decelerate the vehicle, the driver may release the accelerator pedal and depress the brake pedal. If the vehicle is decelerated in this manner with the transmission being held in high gear, the fuelcut control circuit 60 terminates fuel delivery to the engine since the throttle position sensor 10 generates the signal A, the gear position sensor 20 generates the signal B, and the clutch position sensor 40 generates the signal $\overline{D}$. This can save fuel unnecessary during deceleration and enhance the efficiency of engine brake or braking forces caused by loads created during the compression phase of engine operation.

The vehicle may be accelerated in the course of such vehicle deceleration by depressing the clutch pedal to disengage the clutch and operating the shift lever to place the transmission into a low gear, or by depressing the accelerator pedal to advance the throttle valve over the predetermined angle. During these operations, the clutch position sensor 40 generates the signal D and the gear position sensor 20 generates the signal C to cause the AND circuit 634 to generate the signal K, or the throttle position sensor 10 terminates the signal A to cause the inverter 633 to generate the signal $\overline{A}$. As a result, the output of the OR circuit 635 goes high to reset the flip-flop 636, causing the fuelcut control circuit 60 to resume fuel delivery to the engine.

If the engine is operating at a speed less than the predetermined value under these conditions, the restart control circuit 70 will restart the engine when the driver operates the shift lever to place the transmission in a low gear and depresses the clutch pedal to disengage the clutch. Alternatively, if the engine is operating at a speed more than the predetermined value under these conditions, the restart control circuit 70 cannot restart the engine although the engine is started by driving forces from the drive wheels. Thus, the engine can be restarted smoothly without impacts since it is restarted by the restart device such as a starter motor when the transmission is in a low gear having a large gear ratio and by driving forces from the drive wheels when the transmission is in a high gear having a small gear ratio.

Thereafter, the fuelcut control circuit 70 disables the restart device to stop restarting the engine when the engine speed exceeds over the predetermined value to cause the engine speed sensor 50 to terminate the generation of the signal E and/or the clutch pedal is released to engage the clutch to cause the clutch position sensor 40 to terminate the generation of the signal D. This prevents the starter motor from operating while the engine is operating and keeps the starter motor from failure.

While the vehicle is at rest, the transmission is held in neutral, the clutch pedal is released. Thus, the fuelcut control circuit 60 terminates fuel delivery to the engine in the presence of the signals A, B and $\overline{D}$. The vehicle can be started from rest by depressing the clutch pedal to disengage the clutch and operating the shift lever to select a low gear as described hereinbefore.

While the present invention has been described in conjunction with specific embodiments thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. An apparatus for controlling an internal combustion engine of an automotive vehicle having a transmission, a clutch, a throttle valve, and sources for generating signals indicative of: (a) the throttle valve opening at an angle less than a predetermined value, (b) the transmission being in high gear or in neutral, (c) the transmission being in low gear, (d) the engine operating at a speed less than a predetermined value, and (e) the clutch being disengaged, said apparatus comprising means for terminating delivery of fuel to the engine upon the occurrence of two conditions indicated by signals (a) and (b), and means for restarting the engine upon the occurrence of three conditions indicated by signals (c), (d) and (e).

2. The apparatus of claim 1, wherein the means for restarting the engine comprises a first AND circuit for generating a signal (f) upon the generation of two signals (c) and (e), a second AND circuit for generating a signal (g) upon the generation of two signals (d) and (f), and means responsive to the signal (g) from the second AND circuit for restarting the engine.

3. The apparatus of claim 1 or 2, wherein the means for terminating delivery of fuel to the engine comprises an AND circuit for producing a signal (h) upon the generation of two signals (a) and (b), and means responsive to the signal (h) for terminating fuel delivery to the engine.

4. The apparatus of claim 1, wherein the means for terminating delivery of fuel to the engine comprises a hold circuit for maintaining fuel delivery to the engine until the two conditions indicated by signals (a) and (b) continue over a predetermined time.

5. The apparatus of claim 4, wherein the means for restarting the engine comprises a first AND circuit for generating a signal (f) upon the generation of two signals (c) and (e), a second AND circuit for generating a signal (g) upon the generation of two signals (d) and (f), and means responsive to the signal (g) from the second AND circuit for restarting the engine.

6. The apparatus of claim 4 or 5, wherein the means for terminating delivery of fuel to the engine comprises a third AND circuit for generating a signal (h) upon the generation of two signals (a) and (b), a hold circuit for generating a signal (i) a predetermined time after the generation of the signal (h), and means responsive to signal (i) for terminating fuel delivery to the engine.

7. The apparatus of claim 6, wherein the hold circuit comprises a resistor connected at its one end to the output of the third AND circuit and at the other end to ground through a capacitor, a diode connected in parallel with the resistor in a polarity to permit current flow in a direction for discharging the capacitor, and a buffer circuit having an input connected to the other end of the resistor for generating the signal (i) when the voltage at its input exceeds over a predetermined time.

8. The apparatus of claim 1, wherein the means for terminating delivery of fuel to the engine comprises a hold circuit for maintaining fuel delivery to the engine until the condition indicated by signal (b) continues over a predetermined time.

9. The apparatus of claim 8, wherein the means for restarting the engine comprises a first AND circuit for generating a signal (f) upon the generation of two signals (c) and (e), a second AND circuit for generating a signal (g) upon the generation of two signals (d) and (f), and means responsive to the signal (g) from the second AND circuit for restarting the engine.

10. The apparatus of claim 8 or 9, wherein the means for terminating delivery of fuel to the engine comprises a hold circuit for generating a signal (b′) a predetermined time after the generation of the signal (b), a third AND circuit for generating a signal (h) upon the generation of two signals (a) and (b′), and means responsive to the signal (h) for terminating fuel delivery to the engine.

11. The apparatus of claim 10, wherein the hold circuit comprises a resistor connected at its one end to the output of the source for generating signal (b) and at the other end to ground through a capacitor, a diode connected in parallel with the resistor in a polarity to permit current flow in a direction for discharging the capacitor, and the junction of the resistor and the capacitor being connected to one input of the third AND circuit.

12. The apparatus of claim 1, wherein the means for terminating delivery of fuel to the engine comprises means for maintaining fuel delivery to the engine unless the clutch is engaged.

13. The apparatus of claim 12, wherein said means for restarting the engine comprises means for generating a set signal upon the generation of three signals (c), (d) and (e), means for generating a reset signal in the absence of signal (d) or signal (e), a bistable circuit responsive to the set signal for changing to its second stable state generating a signal (f), said bistable circuit being responsive to the reset signal for returning to its first stable state terminating the generation of the signal (f), and means responsive to the signal (f) for restarting the engine.

14. The apparatus of claim 12 or 13, wherein the means for terminating delivery of fuel to the engine comprises a source for generating a signal (g) indicative of the clutch being engaged, means for generating a set signal upon the generation of three signals (a), (b) and (g), means for generating a reset signal upon the generation of two signals (c) and (e) or in the absence of signal (a), a bistable circuit responsive to the set signal for changing to its second stable state generating the signal (h), the bistable circuit being responsive to the reset signal for returning to its first stable state terminating the generation of the signal (h), and means responsive to the signal (h) for terminating fuel delivery to the engine.

15. The apparatus of claim 1, wherein the means for terminating delivery of fuel to the engine comprises a source for generating a signal (g) indicative of the clutch being engaged, and a hold circuit for maintaining fuel delivery to the engine until the three conditions indicated by signals (a), (b) and (g) continues over a predetermined time.

16. The apparatus of claim 15, wherein the means for restarting the engine comprises means for generating a set signal upon the generation of three signals (c), (d), and (e), means for generating a reset signal in the absence of signal (d) or signal (e), a bistable circuit responsive to the set signal for changing to its second stable state generating a signal (f), said bisable circuit being responsive to the reset signal for returning to its first stable state terminating the generation of the signal (f), and means responsive to the signal (f) for restarting the engine.

17. The apparatus of claim 15 or 16, wherein the means for terminating delivery of fuel to the engine comprises means for generating a signal (i) upon the generation of three signals (a), (b) and (g), the hold circuit generating a set signal when the signal (i) continues over the predetermined time, means for generating a reset signal upon the generation of two signals (c) and (e) or in the absence of signal (a), a bistable circuit responsive to the set signal for changing to its second stable state generating a signal (h), said bistable circuit being responsive to the reset signal for returning to its first stable state terminating the generation of the signal (h), and means responsive to the signal (h) for terminating fuel delivery to the engine.

* * * * *

UNITED STATES PATENT AND TRADEMARK OFFICE

CERTIFICATE OF CORRECTION

PATENT NO. : 4,421,082

DATED : December 20, 1983

INVENTOR(S) : Shinji KATAYOSE, Masatsugu OHWADA

It is certified that error appears in the above-identified patent and that said Letters Patent is hereby corrected as shown below:

On the title page:
IN THE BIBLIOGRAPHICAL DATA:

[30] Foreign Application Priority Data

| | | | |
|---|---|---|---|
| August 19, 1981 | [JP] | Japan | 56-130461 |
| August 19, 1981 | [JP] | Japan | 56-130462 |
| August 19, 1981 | [JP] | Japan | 56-130463 |
| August 19, 1981 | [JP] | Japan | 56-130464 |
| August 19, 1981 | [JP] | Japan | 56-130465 |

Signed and Sealed this

*Seventeenth* Day of *April 1984*

[SEAL]

*Attest:*

GERALD J. MOSSINGHOFF

*Attesting Officer*

*Commissioner of Patents and Trademarks*